US010511126B2

(12) United States Patent
Shimizu et al.

(10) Patent No.: US 10,511,126 B2
(45) Date of Patent: Dec. 17, 2019

(54) MOVABLE CONNECTOR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Hiroshi Shimizu, Mie (JP); Ryouya Okamoto, Mie (JP); Hitoshi Takeda, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/078,940

(22) PCT Filed: Feb. 16, 2017

(86) PCT No.: PCT/JP2017/005627
§ 371 (c)(1),
(2) Date: Aug. 22, 2018

(87) PCT Pub. No.: WO2017/154497
PCT Pub. Date: Sep. 14, 2017

(65) Prior Publication Data

US 2019/0052017 A1 Feb. 14, 2019

(30) Foreign Application Priority Data

Mar. 9, 2016 (JP) ..... 2016-045219

(51) Int. Cl.
*H01R 13/64* (2006.01)
*H01R 13/631* (2006.01)
*H01R 13/502* (2006.01)

(52) U.S. Cl.
CPC ..... *H01R 13/6315* (2013.01); *H01R 13/5025* (2013.01)

(58) Field of Classification Search
CPC ..... H01R 13/6315; H01R 13/22; H01R 23/7005; H01R 13/6275
(Continued)

(56) References Cited

U.S. PATENT DOCUMENTS 6,830,469 B1 * 12/2004 Doyle ..... H01R 13/6273 439/247
8,579,655 B2 11/2013 Kawamura
(Continued)

FOREIGN PATENT DOCUMENTS

JP 2004-259501 9/2004
JP 2005-174687 6/2005
(Continued)

OTHER PUBLICATIONS

Official Communication issued in International Bureau of WIPO Patent Application No. PCT/JP2017/005627, dated Apr. 18, 2017.

*Primary Examiner* — Phuong Chi Thi Nguyen
(74) *Attorney, Agent, or Firm* — Greenblum & Bernstein, P.L.C.

(57) ABSTRACT

A movable connector disclosed in the present description includes: a connector having a housing; and a connector mounting part to which the housing is movably mounted. The housing is provided with at least one mounting pin constituted by a plurality of elastic pieces arranged in a circular ring, and the connector mounting part is provided with mounting recesses (mounting tubular portions) that
(Continued)

hold the mounting pin in a state in which it is inserted into the corresponding mounting recess. The mounting pin is capable of relative movement inside the mounting recess in directions that intersect a direction in which the mounting pin is mounted into the mounting recess, and the mounting pin is provided on one or two of the outer peripheral sides of the housing.

11 Claims, 14 Drawing Sheets

(58) Field of Classification Search
USPC ..... 439/247, 289, 378, 350
See application file for complete search history.

(56) References Cited

U.S. PATENT DOCUMENTS

| | | | |
|---|---|---|---|
| 2003/0181097 | A1 | 9/2003 | Hattori et al. |
| 2012/0282789 | A1 | 11/2012 | Kawamura |

FOREIGN PATENT DOCUMENTS

| | | |
|---|---|---|
| JP | 3889979 | 12/2006 |
| JP | 5594538 | 8/2014 |
| JP | 2016-021326 | 2/2016 |

* cited by examiner

MOVABLE CONNECTOR

TECHNICAL FIELD

The technique disclosed in the present description relates to a movable connector that can absorb misalignment with a counterpart member.

BACKGROUND ART

The device connector disclosed in JP 5594538B (Patent Document 1 below) is known as this type of misalignment absorbing mechanism. The device connector includes a cover-side connector and a case-side connector that can be fitted to each other, and the case-side connector is mounted in a mounting recess provided in a terminal block. The case-side connector includes a case-side housing that is elongated in a front-back direction and has a substantially rectangular block shape. The case-side housing is provided with, on the respective outer peripheral sides thereof, cantilever-shaped flexible pieces, that is, four cantilever-shaped flexible pieces in total. On the other hand, the mounting recess is provided with, on its inner side, holding projections that can respectively engage with the flexible pieces, and as a result of the flexible pieces elastically deforming while maintaining their state of engaging with the corresponding holding projections, the case-side connector can move laterally inside the mounting recess.

Furthermore, the receiving side connector disclosed in JP 2004-259501A (Patent Document 2 below) is one of conventional examples known as a configuration different from the above-described device connector. The receiving side connector includes a connector housing, and four ring-shaped spring members project from the outer peripheral sides of the connector housing. As a result of the spring members abutting against the inner side of a mounting hole and elastically deforming, the connector housing can move laterally.

CITATION LIST

Patent Documents

Patent Document 1: JP 5594538B
Patent Document 2: JP 2004-259501A

SUMMARY OF INVENTION

Technical Problem

However, since the above-described device connector is provided with the flexible pieces on all of the outer peripheral sides of the case-side housing, not only the device connector but also the terminal block on which the device connector is mounted increase in size. Furthermore, in the above-described receiving side connector, since the spring members are ring-shaped, the spring members need to have a large diameter in order to reduce the resilient force of the spring member. As a measure for solving the problem, JP 2004-259501A (Patent Document 2 described above) describes use of spiral spring members, instead of the ring-shaped spring members. However, there is concern about an increase in the manufacturing cost for shaping the spring members into a complicated shape such as a spiral shape, as well as an increase in the manufacturing cost for manufacturing additional structures that need to be provided, namely, a bearing structure for supporting the spiral spring members and an outer periphery receiving structure for receiving the outer periphery of the spring members.

Solution to Problem

According to the disclosure of the present description, a movable connector includes a connector having a housing; and a connector mounting part to which the housing is movably mounted, wherein the housing is provided with at least one mounting pin constituted by a plurality of elastic pieces arranged in a circular ring, the connector mounting part is provided with mounting recesses that hold the mounting pin in a state in which it is inserted into the corresponding mounting recess, the mounting pin is capable of relative movement inside the mounting recess in directions that intersect a direction in which the mounting pin is inserted into the mounting recess, and the mounting pin is provided on one or two of the outer peripheral sides of the housing.

According to such a configuration, mounting pins do not need to be provided on the respective outer peripheral sides of the housing, and thus it is possible to downsize the connector, and the connector mounting part can be downsized as a result of the downsizing of the connector. Furthermore, since each mounting pin is constituted by a plurality of elastic pieces arranged in a circular ring, it is possible to simplify the shape of the mounting pin, thereby suppressing the manufacturing cost for shaping the mounting pin.

The movable connector disclosed in the present description may have the following configurations.

Preferably, the mounting pin may be provided on two of the outer peripheral sides of the housing, a clearance may be provided between the elastic pieces and an inner wall of the mounting recess, and each mounting pin may be movable relative to the mounting recess due to the clearance, in a region in which the elastic pieces are not deformed.

According to such a configuration, since the mounting pins can move inside the mounting recesses by an amount corresponding to the clearance, the connector is movable with respect to the connector mounting part.

Preferably, the mounting pin may be provided on two of the outer peripheral sides of the housing, all of the plurality of elastic pieces may abut against inner walls of the mounting recesses, and each mounting pin may be movable relative to the mounting recess as a result of the elastic pieces deforming.

According to such a configuration, since all of the plurality of elastic pieces abut against the inner wall of the mounting recess, the mounting pin can be centered on the mounting recess. Furthermore, as a result of the elastic pieces deforming, the connector is movable with respect to the connector mounting part.

Advantageous Effects of Invention

According to the technique disclosed in the present description, it is possible to achieve a downsized movable connector, which contributes to cost reduction.

DESCRIPTION OF EMBODIMENTS

Embodiment 1

Figure 1:
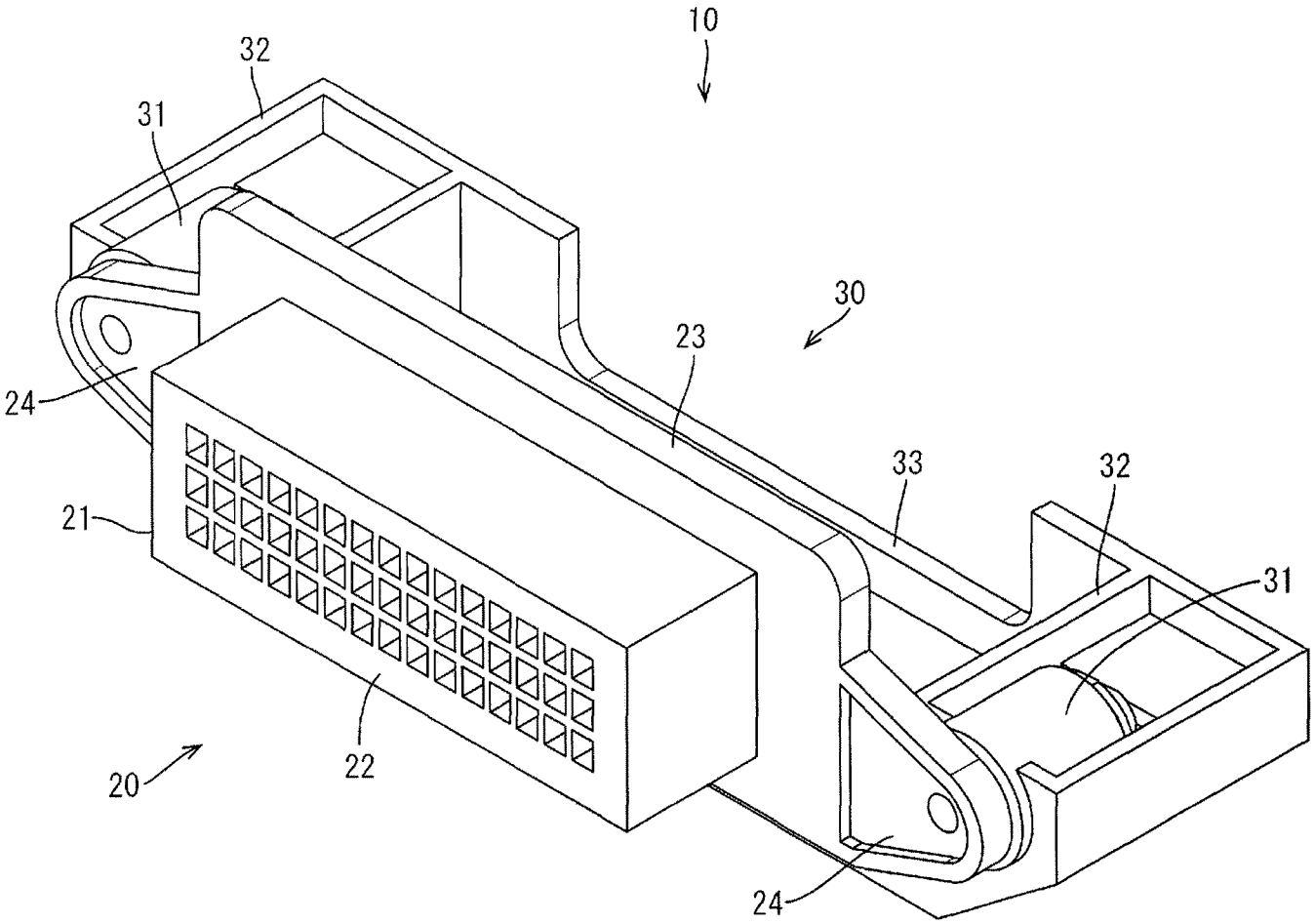
FIG. 1 is a perspective view illustrating a movable connector according to Embodiment 1 as viewed diagonally from the front.
Figure 2:
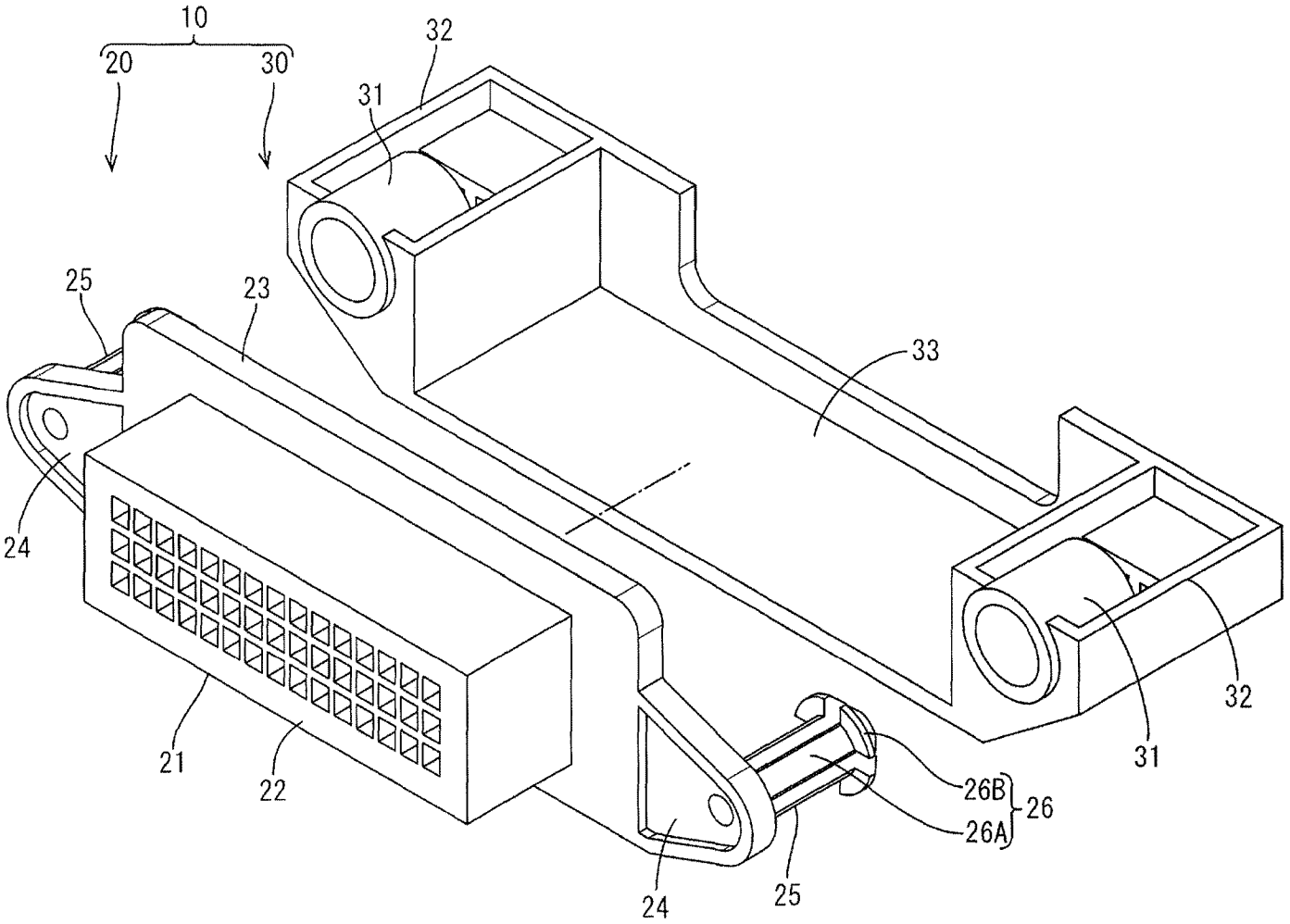
FIG. 2 is a perspective view illustrating a state before the connector is mounted to a connector mounting part as viewed diagonally from the front.
Figure 3:
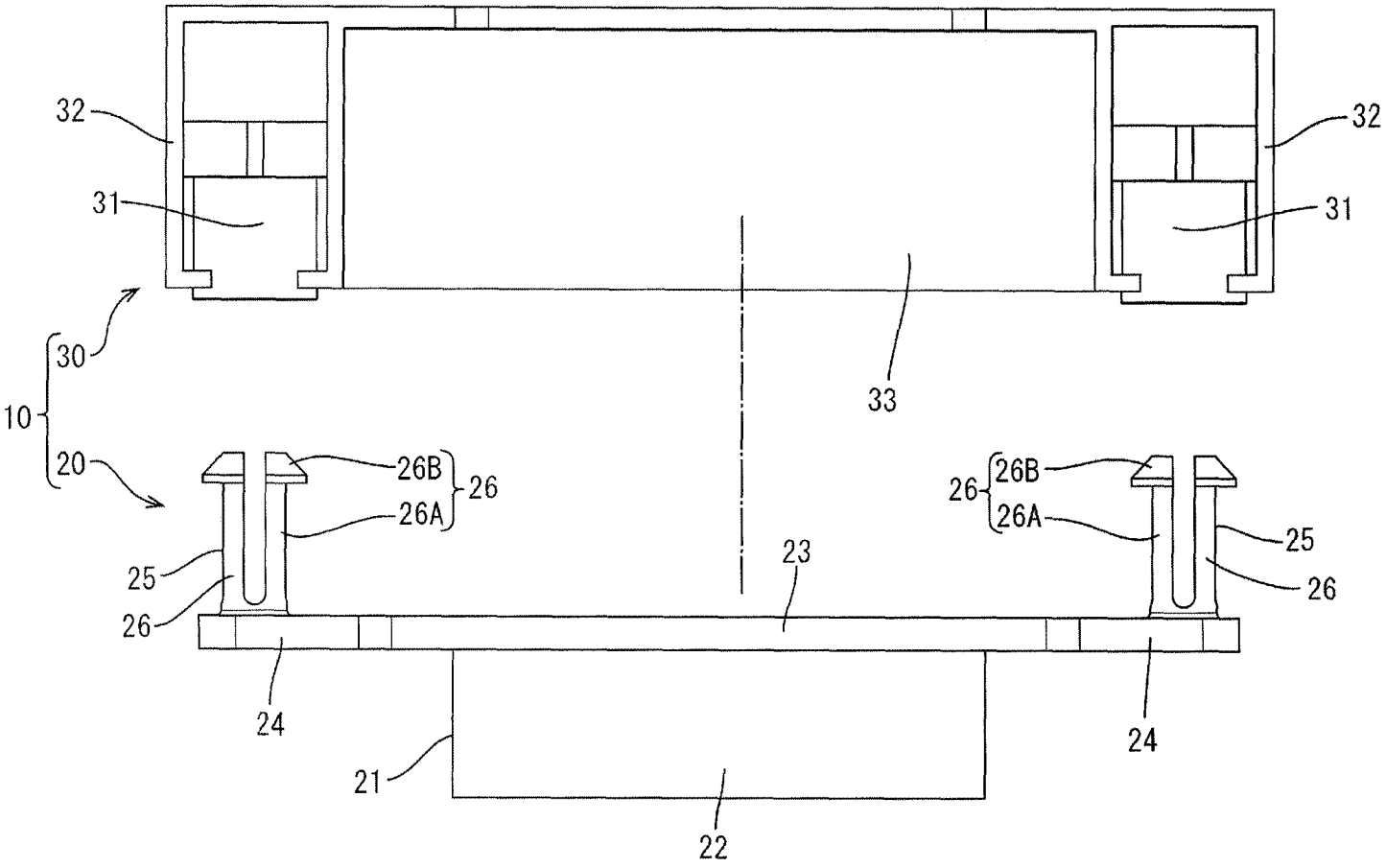
FIG. 3 is a plan view illustrating the state before the connector is mounted to the connector mounting part as viewed from above.
Figure 4:
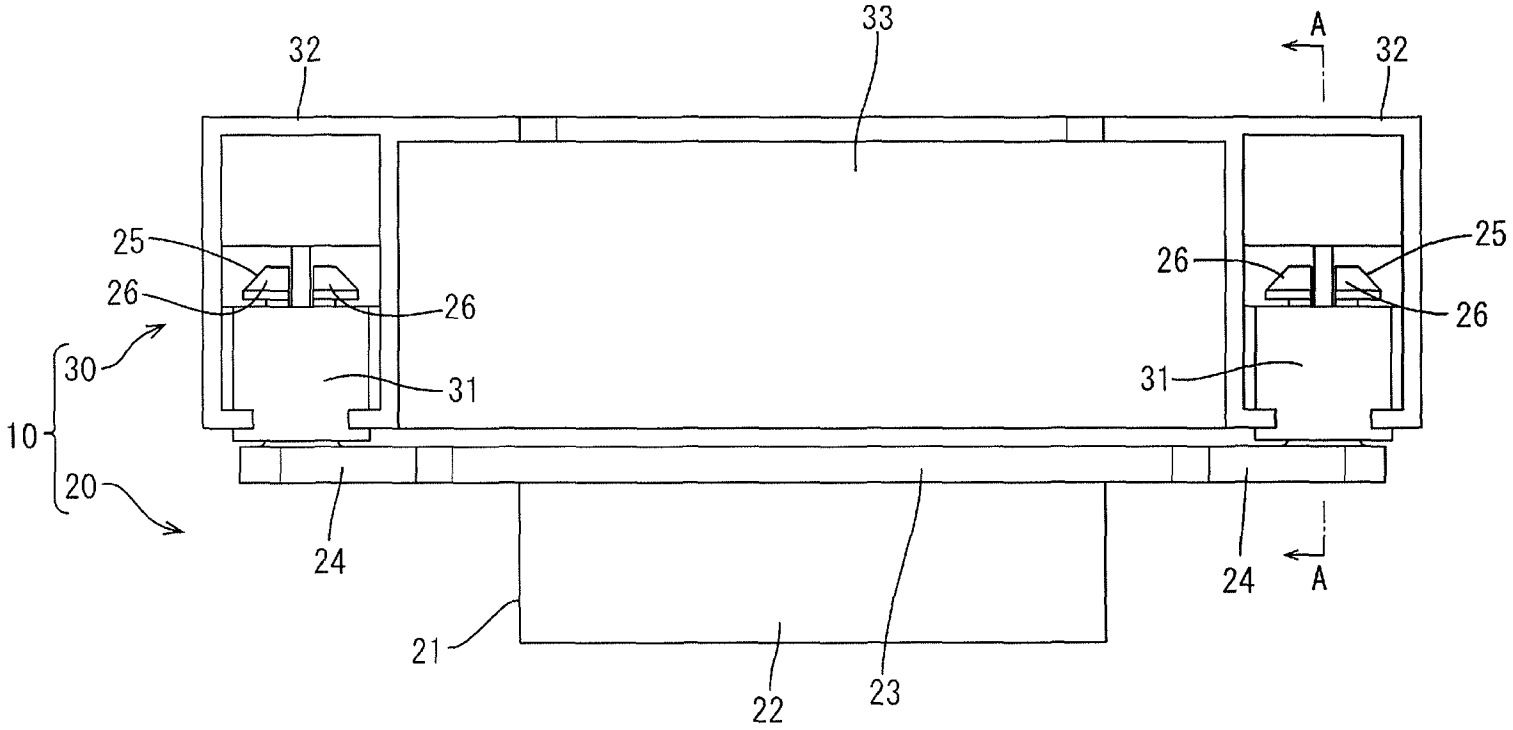
FIG. 4 is a plan view illustrating the movable connector.

Embodiment 1 will be described with reference to the drawings from FIGS. 1 to 8. As shown in FIGS. 1 and 2, a movable connector 10 of Embodiment 1 includes a connector 20 and a connector mounting part 30 to which the connector 20 is mounted. Note that, in the description below, "front-rear direction" is based on a direction in which the connector 20 and a not-shown counterpart connector are fitted to each other, and "front side" refers to a side of the connector 20 that is fitted to the counterpart connector.

The connector 20 includes a housing 21 made of a synthetic resin, and a not-shown terminal that is accommodated inside the housing 21. The housing 21 includes a fitting portion 22 that can be fitted to a counterpart connector, a mounting plate 23 that protrudes outward from the outer peripheral sides of the fitting portion 22 over the entire periphery thereof, and a pair of supporting plates 24 that protrude laterally from two side edges of the mounting plate 23 and each have an almost regular triangle shape.

Behind each supporting plate 24, a mounting pin 25 that is constituted by a plurality of elastic pieces 26 is provided. The elastic pieces 26 are arranged around the axis of the mounting pin 25 in the shape of a circular ring, and are arranged at 90° with respect to each other in a peripheral direction, that is, four elastic pieces 26 in total are provided in Embodiment 1. A pair of elastic pieces 26 that are located at the upper left and upper right positions are arranged side by side in a left-right direction, and a pair of elastic pieces 26 that are located at the lower left and lower right positions are arranged side by side in the left-right direction. Furthermore, a pair of elastic pieces 26 that are located at the upper left and lower left positions are arranged side by side in a vertical direction, and a pair of elastic pieces 26 that are located at the upper right and lower right positions are also arranged side by side in the vertical direction.

Figure 8:
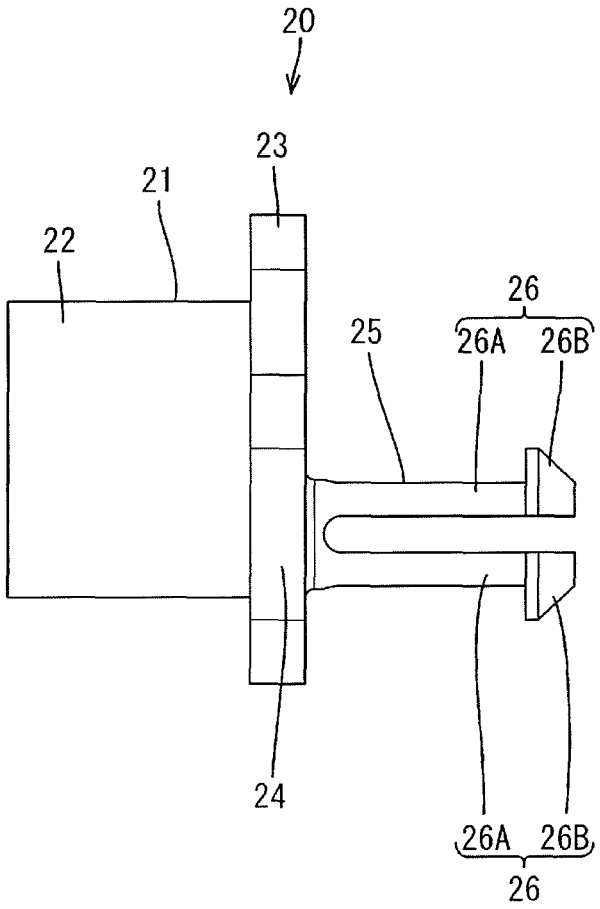
FIG. 8 is a side view of the connector.

As shown in FIG. 8, a flexure space S is provided between a pair of adjacent elastic pieces 26. Each elastic piece 26 is provided with an arm portion 26A that is elastically deformable toward the flexure space S, and a locking claw 26B that protrudes from the leading end of the arm portion 26A.

As shown in FIG. 2, the connector mounting part 30 is provided with: a pair of mounting tubular portions 31 into which the pair of mounting pins 25 are inserted; a pair of fixing portions 32 that respectively hold the pair of mounting tubular portions 31 and are open upward; and a connecting portion 33 that connects the pair of fixing portions 32 to each other.

Figure 5:
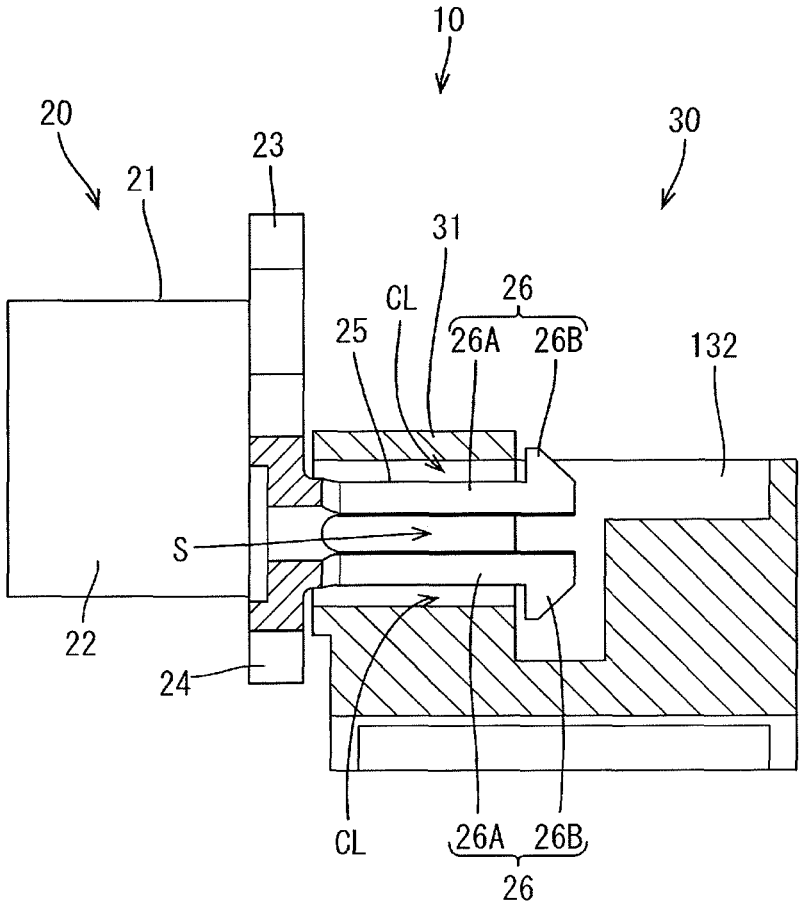
FIG. 5 is a cross-sectional view taken along a line A-A in FIG. 4.
Figure 6:
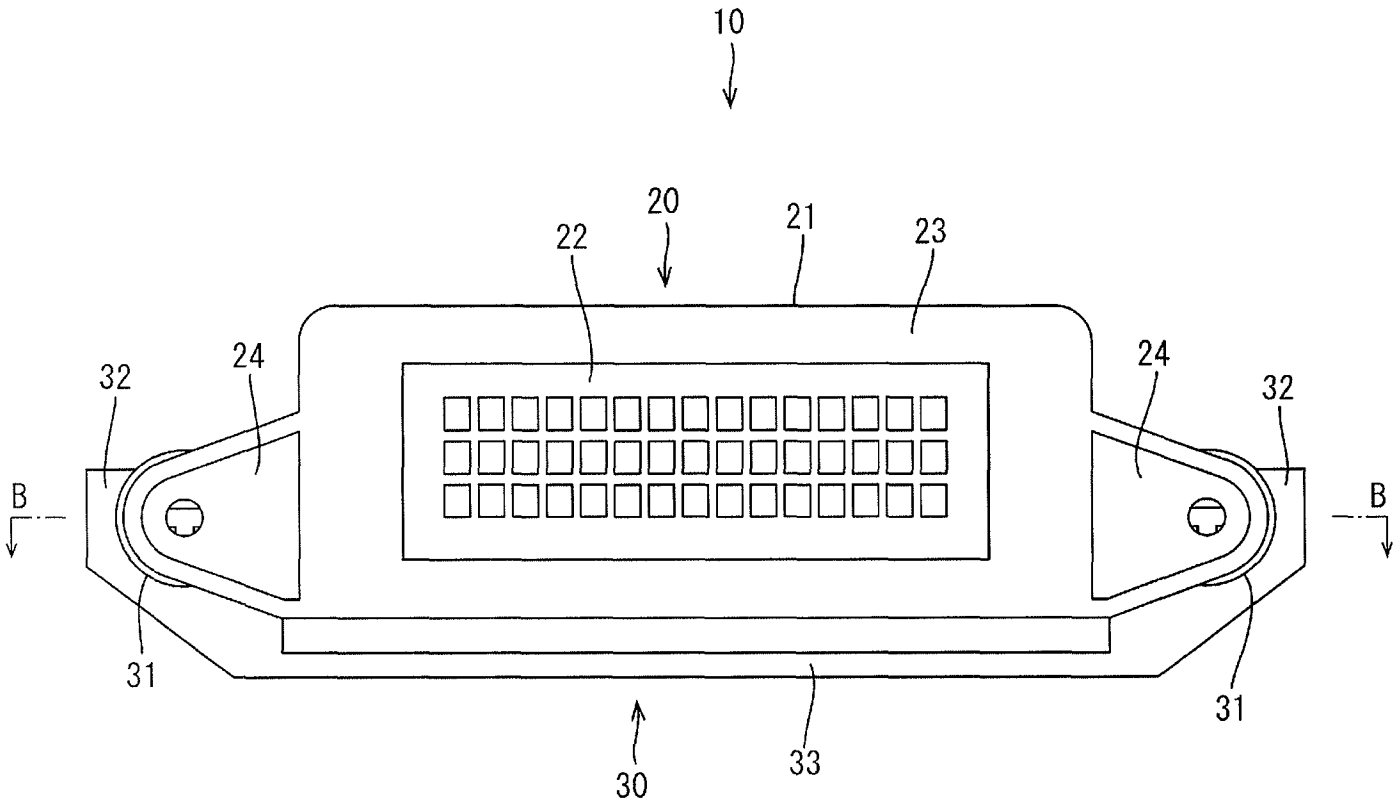
FIG. 6 is a front view of the movable connector.
Figure 7:
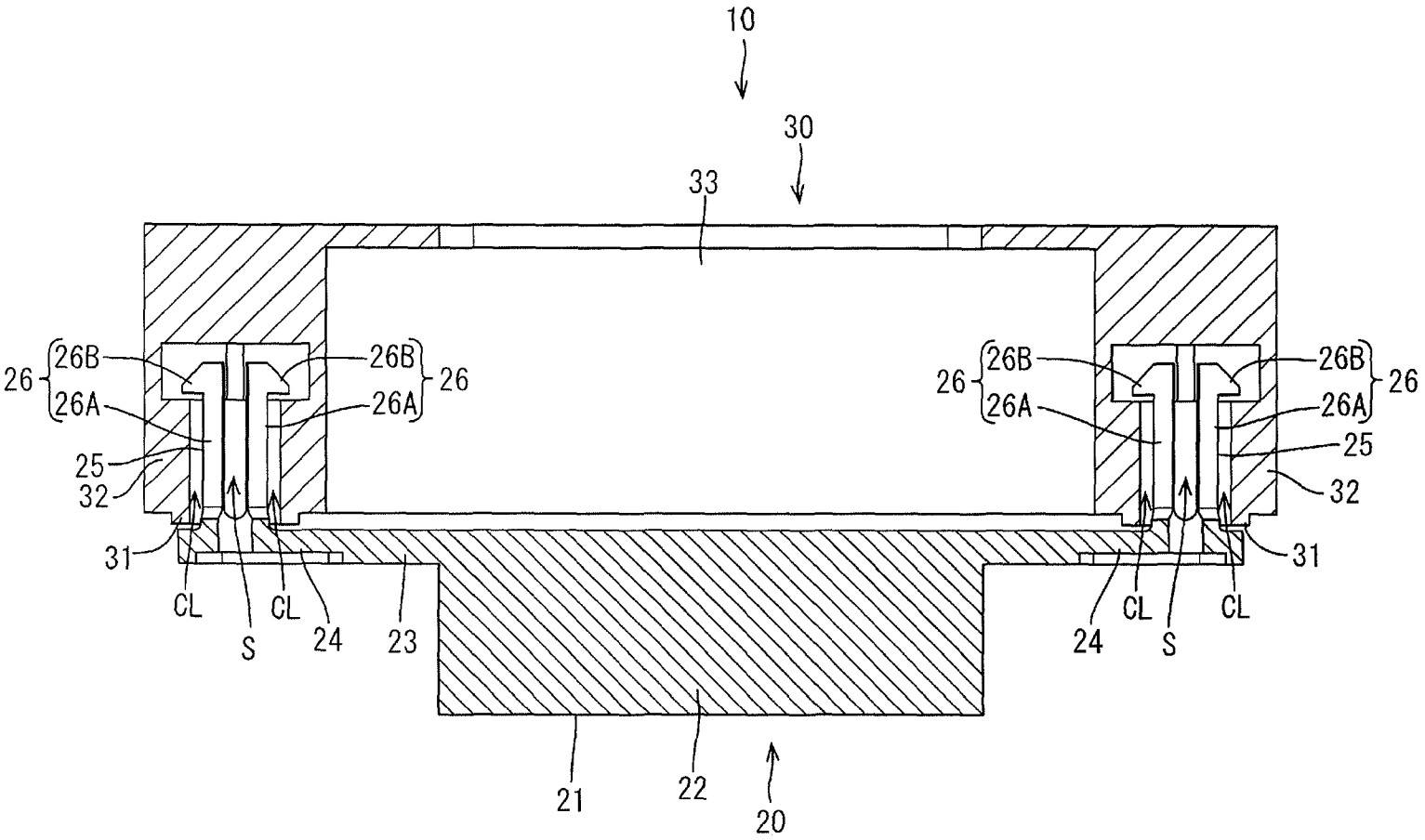
FIG. 7 is a cross-sectional view taken along a line B-B in FIG. 6.

The mounting tubular portions 31 are tubular, and as shown in FIG. 2, the front end portions of the mounting tubular portions 31 protrude forward from the front side of the fixing portions 32. As shown in FIGS. 5 and 6, when the mounting pins 25 are inserted into the mounting tubular portions 31, the locking claws 26B can be locked on the rear end portions of the mounting tubular portions 31. Accordingly, the mounting pins 25 are held in a state of being inserted into the mounting tubular portions 31.

A clearance CL is provided between the arm portions 26A and the inner wall of the mounting tubular portion 31. In Embodiment 1, the elastic pieces 26 can move inside the mounting tubular portion 31, in a region in which the elastic pieces 26 are not deformed (that is, by the clearance CL). Accordingly, the connector 20 is movable relative to the connector mounting part 30 in both the vertical direction and the left-right direction (directions that intersect the front-rear direction).

In Embodiment 1, each mounting pin 25 is constituted by four elastic pieces 26 arranged in a circular ring, and thus a configuration is such that, even if the mounting pin 25 moves inside the mounting tubular portion 31, the locking claw 26B of any of the elastic pieces 26 is locked on the rear end portion of the mounting tubular portion 31. Accordingly, even when the connector 20 is moved relative to the connector mounting part 30, the mounting pins 25 are prevented from being removed from the mounting tubular portions 31.

As described above, according to the movable connector 10 of Embodiment 1, it is not necessary to provide mounting pins 25 on the respective outer peripheral sides of the housing 21, thus making it possible to downsize the connector 20 and achieve a downsized connector mounting part 30 as a result of downsizing the connector 20. Furthermore, since the mounting pins 25 are constituted by a plurality of elastic pieces 26 arranged in a circular ring, it is possible to simplify the shape of the mounting pins 25, thereby suppressing the manufacturing cost for shaping the mounting pins 25.

A configuration may be such that the mounting pins 25 are provided on two of the outer peripheral sides of the housing 21, a clearance CL is provided between the elastic pieces 26 and the inner wall of the corresponding mounting recess (mounting tubular portion 31), and the mounting pins 25 are movable relative to the mounting recesses due to the clearance CL, in a region in which the elastic pieces 26 are not deformed.

With such a configuration, the mounting pins 25 are movable inside the mounting recesses by an amount that corresponds to the clearance CL, and thus it is possible to move the connector 20 with respect to the connector mounting part 30.

Embodiment 2

Figure 9:
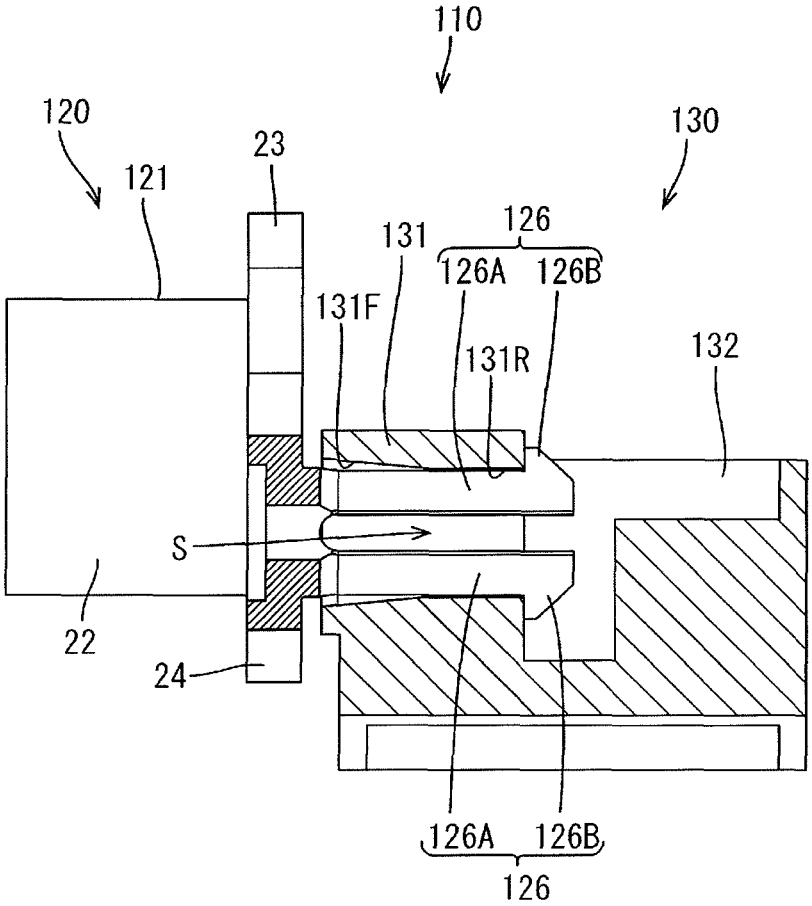
FIG. 9 is a cross-sectional view of a movable connector according to Embodiment 2, corresponding to FIG. 5.
Figure 10:
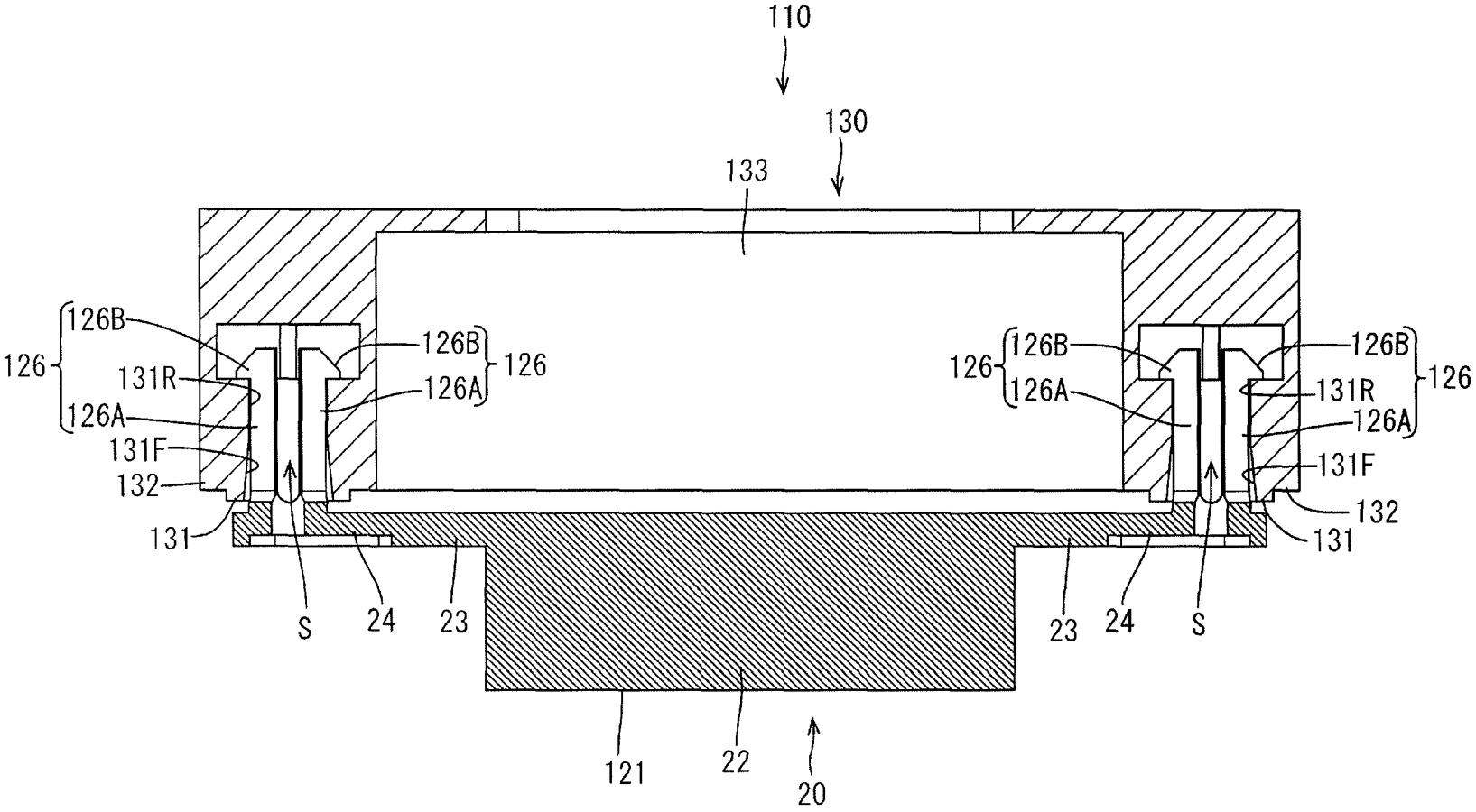
FIG. 10 is a cross-sectional view of the movable connector of Embodiment 2, corresponding to FIG. 7.

The following will describe Embodiment 2 with reference to the drawings of FIGS. 9 and 10. A movable connector 110 according to Embodiment 2 is obtained by partially modifying the configurations of the mounting pins 25 and the mounting tubular portions 31 of Embodiment 1, but the other configurations are same, and thus redundant descriptions of the same configurations as in Embodiment 1 are omitted. The same configurations as in Embodiment 1 are denoted by the same reference numerals as in Embodiment 1, and the configurations different from those in Embodiment 1 are denoted by reference numerals obtained by adding 100 to the numeric characters of the reference numerals in Embodiment 1.

As shown in FIG. 9, elastic pieces 126 of Embodiment 2 each include an arm portion 126A and a locking claw 126B, and the arm portions 126A abut against a rear half 131R of the inner wall of a mounting tubular portion 131. On the other hand, a front half 131F of the inner wall of the mounting tubular portion 131 is configured as a tapered surface in which the mounting tubular portion 131 has a diameter that increases toward the front side. Accordingly, the arm portions 126A do not come into contact with the front half 131F of the inner wall of the mounting tubular portion 131.

Since the arm portions 126A abut against the rear half 131R of the inner wall of the mounting tubular portion 131, a mounting pin 125 and the mounting tubular portion 131 are arranged coaxially, and the mounting pin 125 is centered on the mounting tubular portion 131. Furthermore, as a result of the base end side of the elastic pieces 126 deforming in a region of the front half 131F of the inner wall of the mounting tubular portion 131, a connector 120 is movable relative to the connector mounting part 130 in both the vertical direction and the left-right direction (directions that intersect the front-rear direction).

As described above, the movable connector 110 according to Embodiment 2 is configured such that the mounting pins 125 are respectively provided on two of the outer peripheral sides of the housing 121, all of the plurality of elastic pieces 126 abut against the inner walls of the mounting recesses (mounting tubular portions 131), and the mounting pins 125 are movable relative to the mounting recesses as a result of the elastic pieces 126 deforming.

With such a configuration, since all of the plurality of elastic pieces 126 abut against the inner walls of the mounting recesses, the mounting pins 125 can be centered on the mounting recesses. Furthermore, as a result of the elastic pieces 126 deforming, the connector 120 is movable with respect to the connector mounting part 130.

Embodiment 3

Figure 11:
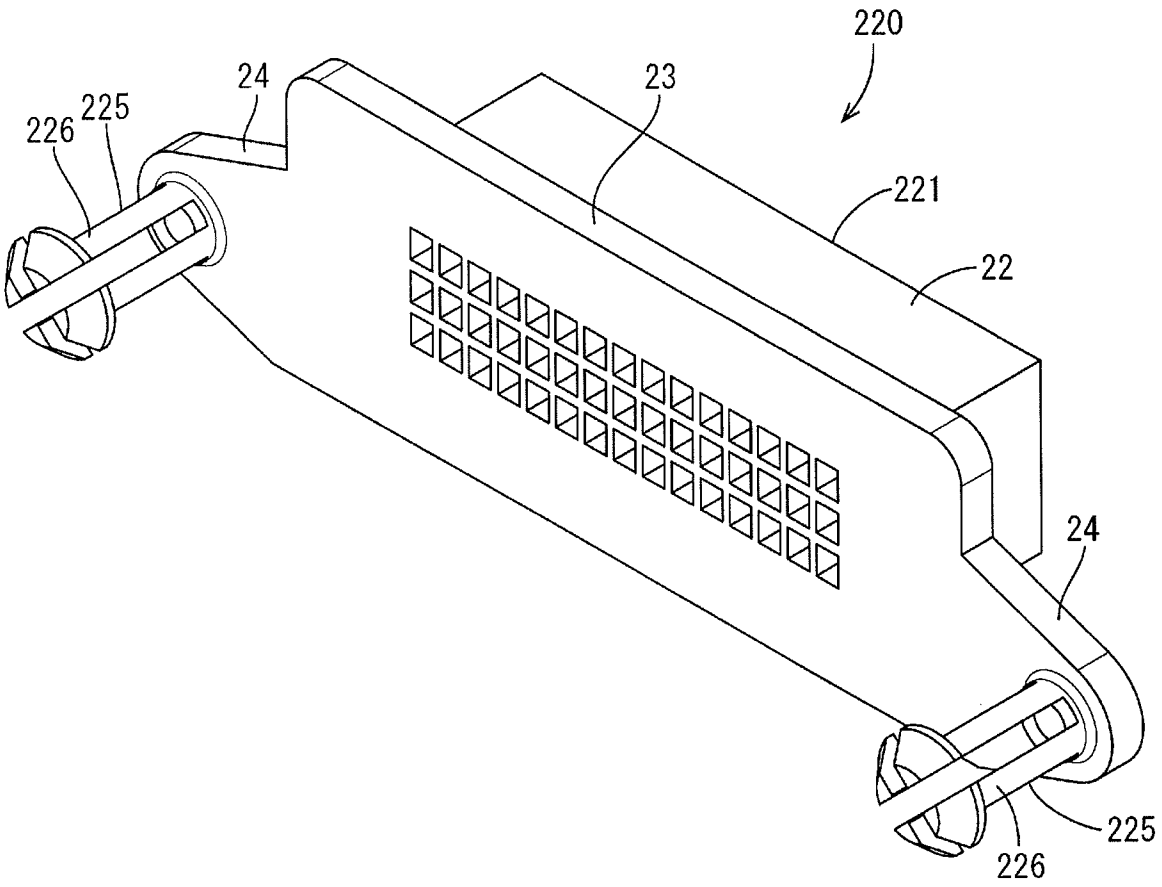
FIG. 11 is a perspective view illustrating a connector according to Embodiment 3 as viewed diagonally from the rear.
Figure 12:
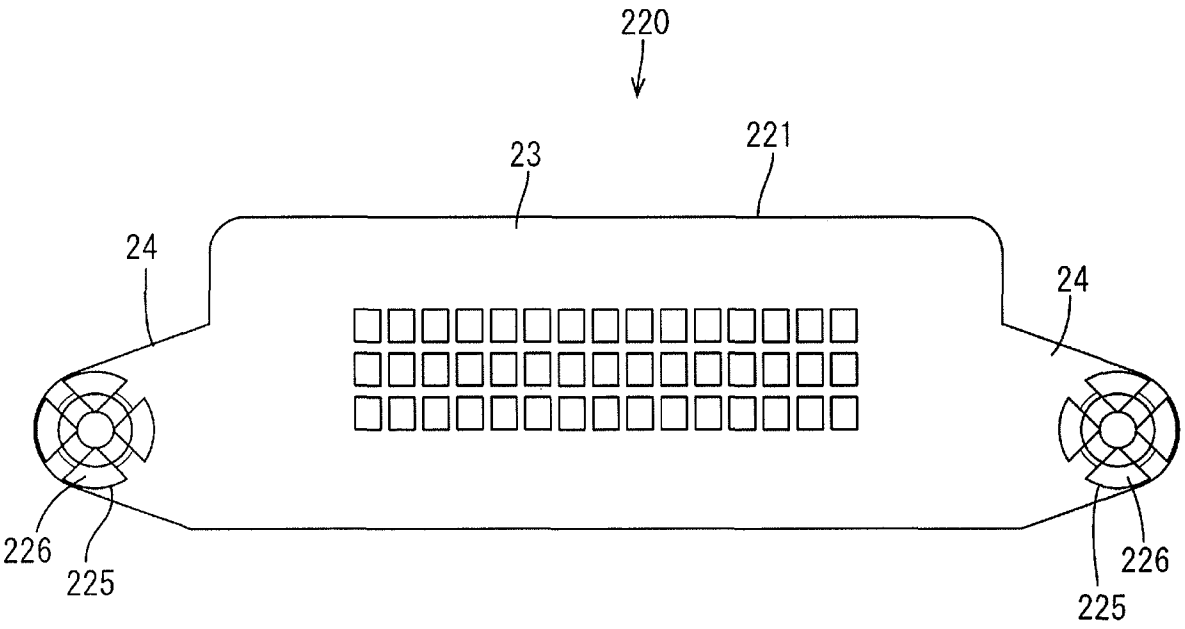
FIG. 12 is a back view of the connector of Embodiment 3 as viewed from the rear.

The following will describe Embodiment 3 with reference to the drawings of FIGS. 11 and 12. A movable connector according to Embodiment 3 is obtained by modifying the layout of the elastic pieces 26 of Embodiment 1, but the other configurations are same, and thus redundant descriptions of the same configurations as in Embodiment 1 are omitted. The same configurations as in Embodiment 1 are denoted by the same reference numerals as in Embodiment 1, and the configurations different from those in Embodiment 1 are denoted by reference numerals obtained by adding 200 to the numeric characters of the reference numerals in Embodiment 1.

As shown in FIG. 11, mounting pins 225 of Embodiment 3 are each constituted by four elastic pieces 226 similar to the mounting pins 25 of Embodiment 1. As shown in FIG. 12, the upper elastic piece 226 and the lower elastic piece 226 are arranged side by side in the vertical direction, and the left elastic piece 226 and the right elastic piece 226 are arranged side by side in the left-right direction.

Embodiment 4

Figure 13:
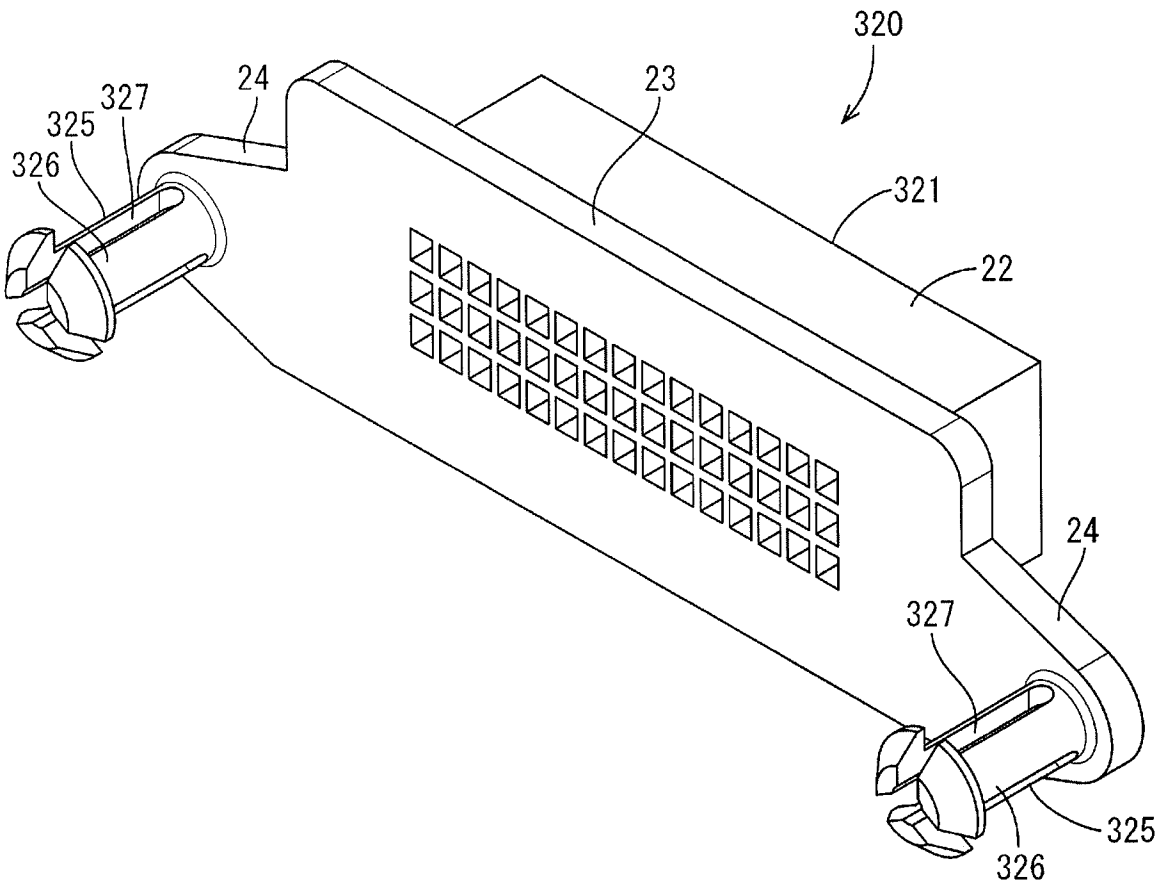
FIG. 13 is a perspective view of a connector according to Embodiment 4 as viewed diagonally from the rear.
Figure 14:
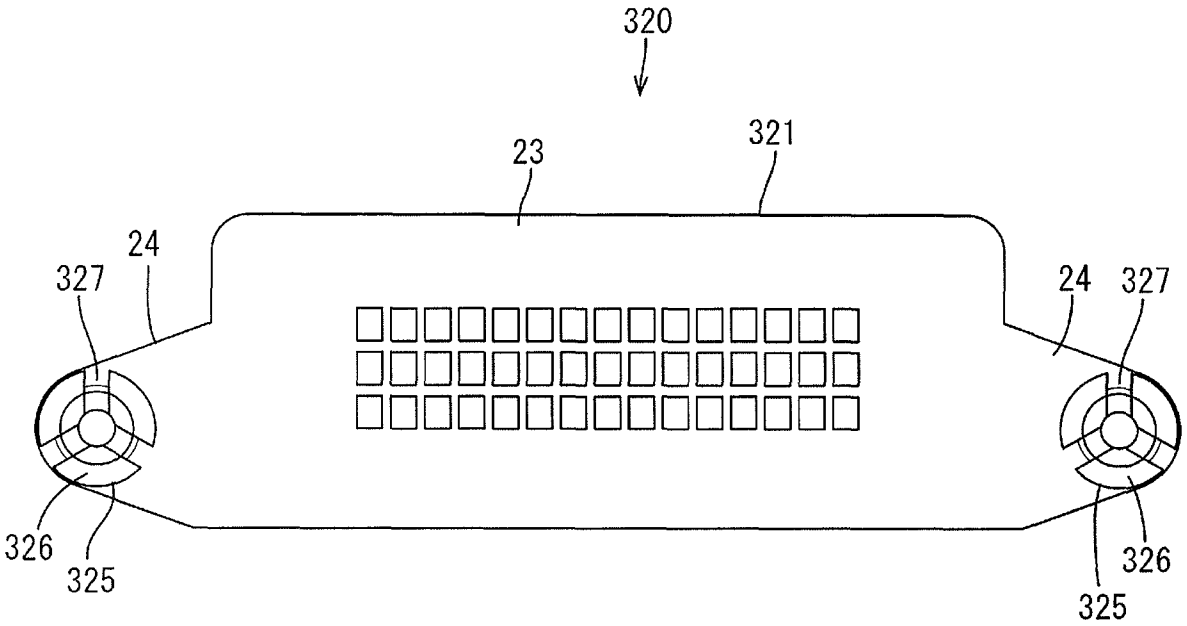
FIG. 14 is a back view of the connector of Embodiment 4 as viewed from the rear.

The following will describe Embodiment 4 with reference to the drawings of FIGS. 13 and 14. A movable connector of Embodiment 4 is obtained by modifying the number and layout of the elastic pieces 26 of Embodiment 1, but the other configurations are same, and thus redundant descriptions of the same configurations as in Embodiment 1 are omitted. The same configurations as in Embodiment 1 are denoted by the same reference numerals as in Embodiment 1, and the configurations different from those in Embodiment 1 are denoted by reference numerals obtained by adding 300 to the numeric characters of the reference numerals in Embodiment 1.

As shown in FIG. 13, mounting pins 325 of Embodiment 4 are each constituted by three elastic pieces 326, in contrast to the mounting pins 25 of Embodiment 1. The elastic pieces 326 are arranged at regular intervals (at 120° with respect to each other) in a circular ring. As shown in FIG. 14, the upper left elastic piece 326 and the upper right elastic piece 326 are arranged side by side in the left-right direction, and the lower elastic piece 326 is arranged below a separation groove 327, which separates the upper left and the upper right elastic pieces 326.

Other Embodiments

The technique disclosed in the present description is not limited to the embodiments explained with reference to the description above and the drawings, and may encompass, for example, the following various aspects:

(1) In Embodiments 1 to 4, the mounting pins are respectively provided on the pair of supporting plates 24 (that is, the mounting pins are provided on two of the outer peripheral sides of the housing 21), but it is also possible that only either one of the supporting plates 24 is provided with a mounting pin (that is, a mounting pin may be provided on one of the outer peripheral sides of the housing 21). In this case, a configuration may be such that the other supporting plate 24 is provided with a rod-shaped shaft portion without a locking claw, and the shaft portion is movable inside the fitting tubular portion by the clearance CL.

(2) In Embodiment 1, the mounting pins 25 are movable due to the clearance CL in a region in which the elastic pieces 26 are not deformed, but the mounting pins 25 may also be movable by more than the amount of movement due to the clearance CL with the elastic pieces 26 deformed.

(3) In Embodiment 2, the base end side of the cantilever-shaped elastic pieces 126 are deformed, but it is also possible that the elastic pieces are made deformable by being U-shaped or ring-shaped.

LIST OF REFERENCE NUMERALS

10, 110 . . . Movable connector
20, 120, 220, 320 . . . Connector
21, 121, 221, 321 . . . Housing
25, 125, 225, 325 . . . Mounting pin
26, 126, 226, 326 . . . Elastic piece
30, 130 . . . Connector mounting part
31, 131 . . . Mounting tubular portion (mounting recess)
CL . . . Clearance

The invention claimed is:

1. A movable connector comprising:

a connector having a housing; and a connector mounting part that has a facing surface that faces the connector and to which the housing is movably mounted with the facing surface facing the connector, wherein the connector includes at least one mounting pin, each at least one mounting pin comprising a plurality of elastic pieces that are, in cross-section, arranged in a circular configuration, wherein the connector mounting part includes at least one ring shaped piece defining at least one tubular mounting recess that is configured to receive the at least one mounting pin when the housing is connected to the connector mounting part, wherein the at least one ring shaped piece has an end extending outwardly from the facing surface of the connector mounting part that faces the connector, wherein the at least one mounting pin is capable of relative movement inside the at least one tubular mounting recess in directions that intersect a direction in which the at least one mounting pin is inserted into the at least one tubular mounting recess, and wherein the at least one mounting pin is provided on at least one of the outer peripheral sides of the housing.

2. The movable connector according to claim 1, wherein the at least one mounting pin comprises two mounting pins arranged on two of the outer peripheral sides of the housing, wherein a clearance is provided between the plurality of elastic pieces of each of the two mounting pins and an inner wall of a respective at least one tubular mounting recess, whereby each mounting pin is movable relative to the respective tubular mounting recess due to the clearance, in a region in which the elastic pieces are not deformed.

3. The movable connector according to claim 1, wherein the at least one mounting pin comprises two mounting pins arranged on two of the outer peripheral sides of the housing, wherein all of the plurality of elastic pieces of each of the two mounting pins abut against respective inner walls of respective at least one tubular mounting recesses, whereby each of the two mounting pins is movable relative to the respective tubular mounting recess as a result of the elastic pieces deforming.

4. The movable connector according to claim 1, the housing including a fitting portion, and a mounting plate protruding outward from outer peripheral sides of the fitting portion, and a pair of supporting plates protruding laterally from two side edges of the mounting plate.

5. The movable connector according to claim 4, the at least one mounting pin extending behind each supporting plate.

6. The movable connector according to claim 4, the supporting plates having a substantially triangular shape.

7. The movable connector according to claim 1, wherein the plurality of elastic pieces comprise four elastic pieces that are offset 90° from each other.

8. The movable connector according to claim 1, wherein the plurality of elastic pieces comprise a first pair of elastic pieces that are located, side-by-side, at an upper left and an upper right position of the cross-section of the circular configuration and a second pair of elastic pieces that are located, side-by-side, at a lower left and a lower right position of the cross-section of the circular configuration.

9. The movable connector according to claim 1, wherein the plurality of elastic pieces comprise a first pair of elastic pieces that are located, side-by-side, at an upper left and a lower left position of the cross-section of the circular configuration and a second pair of elastic pieces that are located, side-by-side, at an upper right and a lower right position of the cross-section of the circular configuration.

10. The movable connector according to claim 1, wherein the plurality of elastic pieces comprise a first pair of elastic pieces in which an upper elastic piece and a lower elastic piece are located, side-by-side in a vertical direction, and a second pair of elastic pieces in which a left elastic piece and a right elastic piece are located, side-by-side in a horizontal direction.

11. The movable connector according to claim 1, wherein the plurality of elastic pieces comprise three elastic pieces that are offset 120° from each other.

* * * * *